US005288261A

United States Patent [19]

Spector

[11] Patent Number: 5,288,261

[45] Date of Patent: Feb. 22, 1994

[54] FIGURATIVE TOY MISSILE

[76] Inventor: Donald Spector, 380 Mountain Rd., Union City, N.J. 07087

[21] Appl. No.: 880,092

[22] Filed: May 7, 1992

Related U.S. Application Data

[63] Continuation-in-part of Ser. No. 840,022, Feb. 24, 1992, which is a continuation-in-part of Ser. No. 793,190, Nov. 13, 1991, Pat. No. 5,135,222, which is a continuation-in-part of Ser. No. 743,279, Aug. 9, 1991, Pat. No. 4,917,381, which is a continuation-in-part of Ser. No. 345,405, May 1, 1989, Pat. No. 5,138,721, which is a continuation-in-part of Ser. No. 205,477, Jun. 13, 1988, Pat. No. 4,834,382.

[51] Int. Cl.[5] ..... A63H 3/52

[52] U.S. Cl. ..... 446/267; 446/74; 446/226; 273/58 H

[58] Field of Search ..... 446/267, 369, 226, 223, 446/68, 74, 73; 273/58 H, 58 F

[56] References Cited

U.S. PATENT DOCUMENTS

| | | | |
|---|---|---|---|
| 14,984 | 8/1894 | Wilson | 446/74 |
| 1,558,200 | 8/1922 | Murphy | 446/226 |
| 1,827,476 | 2/1930 | Kolar | 446/223 |
| 4,568,298 | 2/1986 | Acree | 446/74 |
| 4,805,914 | 2/1989 | Toland | 273/58 H |
| 4,834,382 | 5/1989 | Spector | 273/65 A |
| 4,952,190 | 8/1990 | Tarnoff | 273/58 H |
| 4,986,540 | 1/1991 | Leslie | 273/58 H |
| 5,059,149 | 10/1991 | Stone | 446/369 |
| 5,096,760 | 3/1992 | Thary | 446/369 |
| 5,135,222 | 8/1992 | Spector | 446/220 |
| 5,138,721 | 8/1992 | Spector | 273/65 B |

FOREIGN PATENT DOCUMENTS

| | | | |
|---|---|---|---|
| 448568 | 8/1927 | Fed. Rep. of Germany | 446/226 |
| 9007961 | 7/1990 | PCT Int'l Appl. | 273/58 H |
| 8118 | of 1915 | United Kingdom | 446/226 |

*Primary Examiner*—Robert A. Hafer
*Assistant Examiner*—David Kenealy
*Attorney, Agent, or Firm*—Michael Ebert

[57] ABSTRACT

A figurative toy missile in animal-like or humanoid soft form defined by a head and a torso having appendages extending therefrom. The missile structure is such that when the missile is thrown by a player, it will spin, or execute other excursions in flight, depending on how the appendages are grasped by the player. The torso is formed by an outer fabric casing enclosing a rubber balloon inflated with water, whereby the torso functions as a weighted ball. The head is formed by a shaped, stuffed fabric bag attached to the upper end of the torso casing. The legs and feet are formed by a pair of soft appendages attached to the lower end of the torso casing, and the arms and hands are formed by a pair of soft appendages attached to opposite sides of the torso casing. To alter these flight characteristics so that the missile can do flips and execute other special movements, attached as a removable accessory to the figure is a weighted backpack or other weighted object to impart asymmetrical flying characteristics thereto.

7 Claims, 2 Drawing Sheets

FIGURATIVE TOY MISSILE

RELATED APPLICATION

This application is a continuation-in-part of my pending application Ser. No. 840,022, filed Feb. 24, 1992, entitled "Figurative Toy Missile," which is a continuation-in-part of my pending application Ser. No. 793,190, now U.S. Pat. No. 5,135,222 filed Nov. 13, 1991, entitled "Multi-Mode Playball," this being a continuation-in-part of my patent application Ser. No. 743,279, filed Aug. 9, 1991, entitled "Variable-Weight Play Ball" (now U.S. Pat. No. 4,917,381), which in turn is a continuation-in-part of my patent application Ser. No. 345,405, filed May 1, 1989, now U.S. Pat. No. 5,138,721 entitled "Pneumatic Bolster," this being a continuation-in-part of a still earlier patent application Ser. No. 205,477, filed Jun. 13, 1988, entitled "Inflatable Play Ball" (now U.S. Pat. No. 4,834,382). The entire disclosures of these prior applications are incorporated herein by reference.

BACKGROUND OF INVENTION

1. Field of Invention

This invention relates generally to soft play figures having an animal-like or humanoid soft form, and more particularly to a figure of this type capable of functioning as a missile which when thrown by a player will spin, do flip-flops or execute other excursions in flight, depending on how the appendages of the figure are grasped by the player.

2. Status of Prior Art

The typical inflatable beach ball of the type in commercial use at outdoor swimming pools and beaches is made from 6 to 8 mil polyvinyl film material, the ball being provided with a valved air inlet so that it can be inflated by mouth.

Such thin-skinned beach balls are usually made in a diameter greater than that of a basketball or soccer ball, and they are relatively very light in relation to their surface area. As a consequence, the typical light-weight beach ball offers a much greater surface area to air than smaller balls, and little resistance to wind deflection, so that the ball cannot be thrown very far, and on a windy day it is almost impossible to play with on a beach.

Because even a light wind deflects the beach ball, when the ball is thrown from one player to another, it is more likely to land in the water rather than in the hands of a player, and when blown into the water, the ball may be propelled to a distant point from which it cannot readily be recovered. Children often lose beach balls because of wind conditions. But apart from the difficulty of playing with a light-weight play ball under windy conditions is that its lack of weight imposes other limitations on the ball.

My prior U.S. Pat. No., Spector, 4,834,352, discloses a pneumatic play ball having an outer casing formed of non-stretchable material which when fully expanded assumes a ball configuration. Within the casing is an inflatable balloon whose stem initially projects through a small port in the casing. When the balloon is inflated, it expands to engage and conform to the inner surface of the casing, after which the stem is tied and pushed within the port whereby the balloon is then fully encased. While a ball of the type disclosed in this prior patent has distinct advantages over conventional beach balls, it is still lacking in weight and subject to wind deflection.

To overcome this drawback, my later prior Spector U.S. Pat. No. 4,917,381 discloses a variable weight play ball in which weight is imparted thereto by a layer of water which is uniformly and symmetrically distributed throughout the ball regardless of the thickness of the layer, whereby the play characteristics of the ball are comparable to those of conventional heavy balls of high quality.

This variable-weight play ball has an inflatable inner bladder of elastomeric material disposed within a non-stretchable outer casing of flexible material to create a water region therebetweeen. The outer casing is provided with a valved water inlet through which water is introduced into the water region in an amount which depends on the desired weight of the ball. The inner bladder is provided with a valved air inlet which projects through the outer casing and is accessible from the ball exterior, thereby making it possible to blow up the inner bladder to the degree necessary to cause the water in the region to become evenly distributed therein to create a spherical water layer pressed between the bladder and the casing, the thickness of the layer determining the weight and play characteristics of the ball.

Balloon balls of the type disclosed in my prior patents have a form which is strictly utilitarian, and the flight characteristics of these balls are not very different from conventional light-weight or weighted balls. And while it is possible for the thrower to impart a spin to a conventional ball so that it rotates in the course of its flight, we cannot usually see this spin.

It is not uncommon for children in playing with plush or other soft dolls and figures to throw these toys in play activity. Children also engage in pillow fights in which they attack each other with soft pillows. But soft figures or pillows can be thrown only short distances, for they lack the flight characteristics of a ball.

In my copending application Ser. No. 840,022, entitled Figurative Toy Missile, there is disclosed a figurative toy missile in animal-like or humanoid soft form defined by a head and a torso having appendages extending therefrom. The missile structure is such that when the missile is thrown by a player, it will spin, or execute other excursions in flight, depending on how the appendages are grasped by the player. The torso is formed by an outer fabric casing enclosing a rubber balloon inflated with water, whereby the torso functions as a weighted ball.

The head is formed by a shaped fabric bag attached to the upper end of the torso casing, the bag being filled with soft stuffing. The appendages which constitute the legs and feet are formed by a pair of shaped, elongated fabric sleeves attached to the lower end of the torso casing and filled with soft stuffing. And the appendages which constituted the arms and hands or the forelegs are formed by a pair of shaped, elongated fabric sleeves attached to opposite sides of the torso casing and filled with soft stuffing. When the player grasps the missile by one or more of its appendages and then throws it, the missile will then spin or execute other movements in flight, depending on how the appendages are grasped.

The normal flying characteristics of this figurative toy missile are essentially similar to those of a weighted spherical ball in which the weight is symmetrically distributed, for the stuffed head and appendages attached to the ball-like torso have relatively little weight. Thus the weighted spherical torso in flight exhibits both horizontal and vertical spins, causing it to fly in a more or less steady plane. This limits the movements which the missile is capable of executing in the course of its flight.

SUMMARY OF INVENTION

In view of the foregoing, the main object of this invention is to provide a figurative toy missile having an animal-like or humanoid soft form defined by a ball-shaped weighted torso, and a soft head and soft appendages attached to the torso, the figure having attached thereto a weighted object whereby when the figurative missile is thrown by a player it behaves essentially as a weighted ball having asymmetrical flying characteristics.

More particularly, an object of the invention is to provide a figurative toy missile of the above-noted type in which the torso is defined by an outer fabric casing enclosing a water-inflated balloon, the head and the appendages being attached to the outer casing of the torso and having a soft stuffing therein, the weighted object being in the form of an accessory whose form is appropriate to the figure, such as a weighted backpack which can be strapped onto the figure.

A significant feature of the invention is that when the figurative missile is in flight, it then spins, does flip-flops or executes other movements, depending on how the appendages are grasped by the player. And the nature of ball movement in flight is made evident to those observing the missile, for it is accompanied by movement of the appendages attached to the ball-like torso.

Also an object of the invention is to provide a figurative toy missile which is safe to play with and which may be mass-produced at relatively low cost.

Briefly stated, these objects are attained in a figurative toy missile in an animal-like or humanoid soft form defined by a head and a torso having appendages extending therefrom. The missile structure is such that when the missile is thrown by a player, it will spin, do flip-flops or execute other excursions in flight, depending on how the appendages are grasped by the player. The torso is formed by an outer fabric casing enclosing a rubber balloon inflated with water, whereby the torso functions as a weighted ball. The head is formed by a shaped, stuffed fabric bag attached to the upper end of the torso casing. The legs and feet are formed by a pair of soft appendages attached to the lower end of the torso casing. And the arms and hands are formed by a soft appendages attached to opposite sides of the torso casing.

The figure is capable of being thrown as a missile by a player who grasps at least one of the appendages. The normal flving characteristics of this missile are similar to those of a weighted spherical ball. To alter this characteristic so that the missile in flight can do flips and execute other special movements, attached as a removable accessory to the figure is a weighted backpack or other weighted object whose form is appropriate to the figure to impart asymmetrical flying characteristics thereto.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figurative Toy Missile

Figure 1:
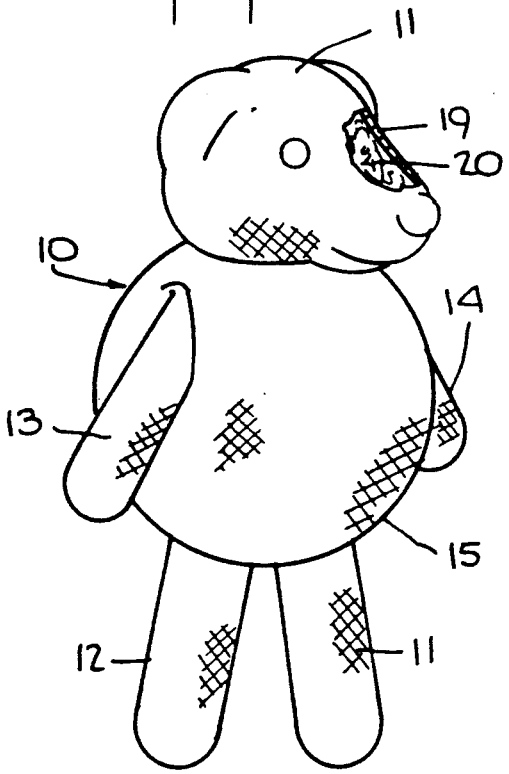
FIG. 1 is a perspective view of a figurative toy missile in accordance with the invention.

Referring now to FIG. 1, there is shown a figurative toy missile according to the invention which is in an animal-like or humanoid form, such as a teddy bear or an ape, depending on its shaping. The figure is formed by a globular weighted torso 10, a head 11 attached to the upper end of the torso, a pair of appendages 11 and 12 attached to the lower end of the torso and a pair of appendages 13 and 14 attached to opposite sides of the torso.

Figure 2:
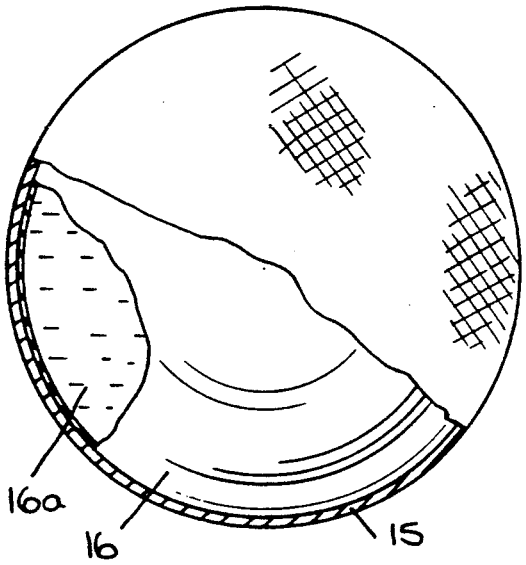
FIG. 2 separately shows in a cut-away view, the ball-like torso of the figure.

Globular torso 10, as shown separately in FIG. 2, is defined by a fabric outer casing 15 which encloses a rubber balloon 16 that is inflated by water 17 to create a weighted ball.

Casing 15 may be created by interfitted, contoured pieces of non-stretchable fabric sheeting sewn together by filamentary thread lines which are not visible on the outer surface of the casing. Alternatively, if the fabric is made of thermoplastic synthetic fibers, the pieces may be ultrasonically seamed together. A preferred fabric for this purpose is parachute cloth which is a high-strength, light-weight, closely-woven fabric made of synthetic fibers such as nylon. Other types of non-stretchable fabrics such as Gore-Tex may be used for the casing material. Also usable are plush fabrics so as to impart a soft feel to the torso of the figure.

Figure 3:
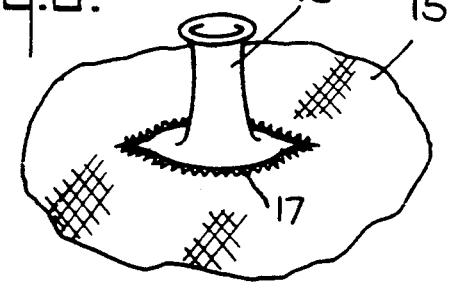
FIG. 3 illustrates a portion of the fabric casing of the ball-like torso, showing the slit or port therein through which the neck of the balloon enclosed by the casing protrudes before the neck is tied to seal the balloon and prevent the escape of water therefrom.

As shown separately in FIG. 3, a slit 17 is cut in casing 15, the borders of the slit being reinforced by cotton, nylon, or other threading that is tightly coiled about the borders and terminates at reinforced points at opposite ends of the slit. In practice, the slit having reinforced borders can be made by using standard buttonhole machines for this purpose, for the slit in the fabric casing functions in a manner comparable to that of a buttonhole; that is, the slit is normally closed, but can be dilated to create an opening to admit a button, the slit then closing the about the button.

The slit is positioned so that it lies between the appendages 11 and 12 at the lower end of the torso. While accessible, slit 17 is effectively concealed. Balloon 16 has a long stem 18 which initially projects through slit 17 in the casing so that in inflating the balloon with water, the water is introduced under pressure through stem 18.

An inflated rubber balloon is easily punctured and notoriously weak in other respects. Indeed, one of the pleasures of playing with balloons is to burst and explode them. As a balloon is being inflated, its rubber skin stretches and the skin which is thin to begin with becomes even thinner until a point is reached in the expanding diameter of the balloon where the skin is ruptured by the internal pressure, at which the balloon bursts.

But in the present arrangement, the water-inflated balloon is confined within a substantially non-stretchable casing so that regardless of how roughly the torso is handled, the confined balloon is not permitted to stretch beyond a point at which it may rupture. In practice, since the balloon is filled with water and leakage thereof must be avoided, a heavy duty balloon or bladder may be used rather than a conventional thin rubber toy balloon.

After the balloon is fully inflated with water, then in order to seal the balloon to retain water therein, one ties neck 15 into a knot which is pushed under casing slit 17, and now the neck is no longer outside the slit. Casing slit 17 is under tension, for the casing is subjected to tension by the inflated rubber balloon. By reason of this tension, slit 17 is then forced to recover its almost fully closed state, thereby encasing the tied balloon.

Head 11 is formed by a shaped bag 19 of fabric material which is the same as or similar to that of the torso casing, the bag being filled with a soft stuffing 20 to give body to the bag. This stuffing may be cotton batting, flexible foam pellets or any other soft stuffing material of the type used in soft toy animals or humanoid figures. The shaping of bag 19 depends, of course, on the nature of the figure. Soft ears of some sort may be formed projecting from the head, whereas the eyes, nose and mouth may be printed on the bag. But in the case of a nose, a small projection may be provided to simulate the nose. Bag 19 is sewn or otherwise secured to the upper end of the fabric torso casing.

Figure 4:
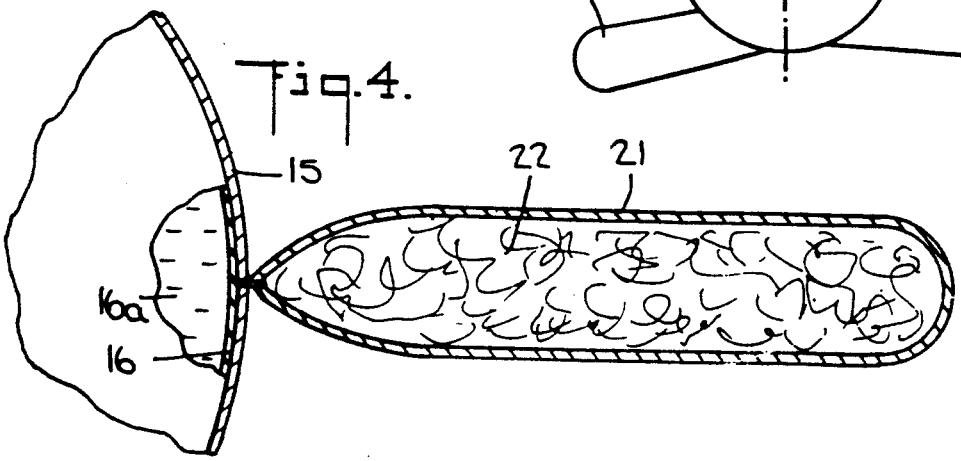
FIG. 4 is a sectional view of one of the stuffed appendages of the figure.

Appendages 11 and 12 are formed by fabric stockings or sleeves attached to the lower end of the fabric torso casing, such as sleeve 21, shown separately in FIG. 4. This sleeve is filled with a soft stuffing 22, which may be the same or similar to the head stuffing. These appendages are shaped to simulate the legs and feet of a humanoid figure, but if the figure is animal-like, the appendages would then simulate the rear legs of the animal and be appropriately placed. In practice, the figure may be in any fanciful form.

Appendages 13 and 14 are also formed of fabric sleeves filled with a soft stuffing, these sleeves being sewn or otherwise attached to opposite sides of the torso casing. The shape of these sleeves is such as to simulate the arms and hands of a humanoid figure or the forelegs of an animal-like figure.

Thus the weight of the figure is concentrated in the water-filled ball-like torso. When, therefore, the figurative missile is held in the hands of a child, it feels like a soft doll or play figure and may be enjoyed as such. But should the child wish to hurl the missile, he can do so in various ways, using the appendages as handles for the ball-like torso or in the manner of a sling.

In play, the thrower with one hand can grasp only appendage 13 of the figure and swing the figure and then release it in a particular direction, in which case the figure, which has a weighted ball-like torso, will travel in a trajectory very much like that of an ordinary ball and be caught by another player and thrown back. Or the thrower can with both hands grasp both appendages 13 and 14 and twirl the figure before releasing it to cause the figure to spin in flight. Alternatively, the thrower can grasp either or both of leg appendages 11 and 12 and so manipulate the figure before releasing it as to cause it to execute other flight patterns.

Figure 5:
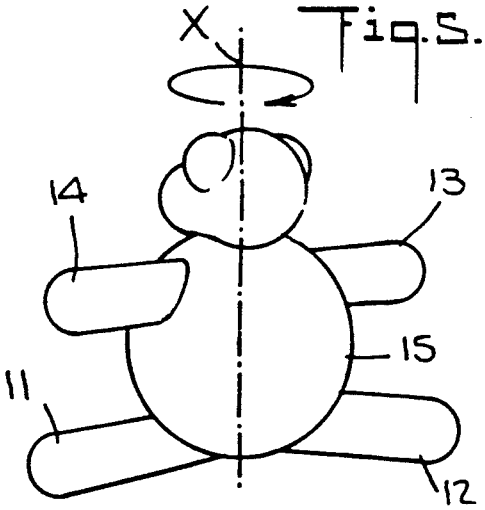
FIG. 5 illustrates the missile in flight when its weighted ball-like torso is spinning about a vertical axis to simulate a flying saucer.

When, as shown in FIG. 5, the figure is so hurled by the player so that it has a spin imparted thereto, causing the figure in the course of its forward flight to rotate about a more or less vertical axis X, then the soft appendages 13 and 14, which are outflung from the torso by centrifugal force, will then curl about the equator of ball-like torso 15. This will appear to observers as a sort of flying saucer. The flight pattern imparted to the figure is determined by the manner in which the thrower grasps the appendages and then manipulates the figure before releasing it. Weighted Accessory:

In the figurative toy missile shown in FIGS. 1 to 5, the weighted torso which is filled with liquid has a generally globular form; hence the liquid is uniformly distributed with respect to the center of the spherical ball. The soft, stuffed head and appendages add relatively little weight to the figure; hence the flying characteristics of this missile are similar to those of a weighted ball which in the course of flight exhibits both horizontal and vertical spins and tends to fly in a more or less steady plane.

We have found that by adding an off center weight to the figure, the resultant flying characteristics are rendered asymmetrical. As a consequence, the missile, instead of flying with spins in a steady plane then tends to do flips. As a result of the eccentric weight added to the spherical weight, the figure is then likely to wobble in the course of flight and to do flips and carry out other special movements. These flips are clearly visible, so that a child playing with the figure can easily count the number of flips executed in the course of flight. Thus depending on how the figure is hurled by a child and the strength of the thrower, one child may succeed in making the figure do three or more flips before the figure comes to rest, while another child throwing the same figure may be able to produce no more than two flips.

Figure 6:
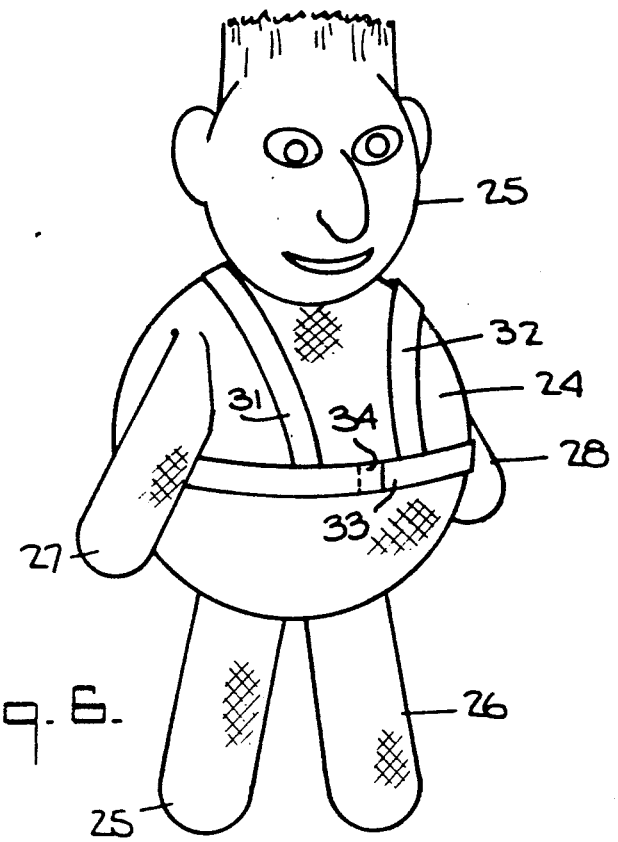
FIG. 6 is a front view of a figure having a weighted backpack accessory attached thereto.
Figure 7:
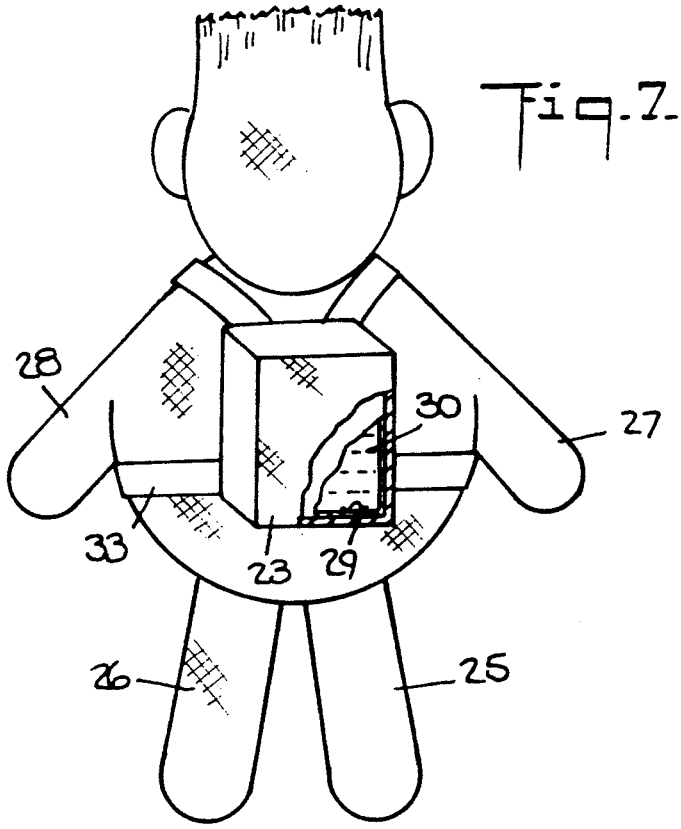
FIG. 7 is a rear view of the figure.

The weighted object attached to the figurative missile is preferably in the form of an accessory that is attachable to the missile and has a form appropriate thereto, such as a weighted backpack 23, as shown in FIGS. 6 and 7.

In this instance, the figure may be that of a well known comic strip, movie or TV character, such as "Charlie Brown" or a member of the "Simpson" family. Like the figure shown in FIG. 1, the character shown in FIGS. 5 and 6 includes a globule weighted torso 24, a stuffed head 25 attached to the upper end of torso 24, the head in this instance being that of a particular character. Attached to the lower end of the torso are soft appendages 25 and 26 whose form is appropriate to the legs and feet of the character. And attached to opposite sides of the torso are soft appendages 27 and 28 whose form is appropriate to the arms and hands of the character.

Backpack 23 is formed by a fabric casing having a generally rectangular inner pocket which is occupied by a balloon 29, which when inflated by water then conforms to the shape of the pocket. Alternatively, the pocket may be filled with sand or other innocuous material imparting weight to the backpack.

To attach backpack 23 to the figure, a pair of shoulder hoops 31 and 32 is provided, as well as a waist strap 33 whose ends terminate in Velcro-type complementary fastener elements 34 so that the backpack accessory may readily be attached to the figure or removed therefrom. Or the weighted accessory may be constituted by a collar-like object that encircles the junction or neck between the head and the torso.

While there has been shown and described a preferred embodiment of a figurative toy missile in accordance with the invention, it will be appreciated that many changes and modifications may be made therein without, however, departing from the essential spirit thereof.

Thus instead of water, the torso casing may be filled with silicone oil, glycerine or any other non-volatile, relatively heavy liquid that requires no germicidal agent to keep it sterile. And instead of a balloon, the liquid may be enclosed within a rubber bladder or flexible plastic casing covered by a fabric outer casing to provide a torso for the figure having the characteristics of a weighted ball.

I claim:

1. A soft toy figure having a humanoid or animal-like form and capable of functioning as a play missile, said figure comprising:

(a) a weighted torso including a globular casing, whereby the torso, which is spherical, functions as a weighted ball having symmetrical flying characteristics; said torso being weighted by a rubber balloon disposed within the globular casing whose neck projects through a slit in the casing, the balloon being inflated by pressurized liquid fed into the balloon to cause it to engage and conform to the casing, the neck thereafter being tied to confine the liquid within the balloon;

(b) a head formed by a bag attached to the upper end of the torso casing and filled with soft stuffing material, said bag being shaped to define the head of a humanoid or animal-like figure;

(c) a pair of soft appendages attached to the lower end of the casing to define the legs and feet of a humanoid figure;

(d) a pair of soft appendages attached to opposite sides of the casing to define the arms and hands of a humanoid figure or the forelegs of an animal-like figure, said figure being capable of being thrown as a missile by a player who grasps at least one of the appendages as a handle to hurl the weighted ball; and (e) a removable weighted accessory attachable to the figure to impart asymmetrical flying characteristics thereto, said accessory being a backpack having an inner pocket containing a balloon inflated with water to conform to said pocket and impart weight to the backpack.

2. A figure as set forth in claim 1, wherein said casing is formed by fabric material.

3. A figure as set forth in claim 1, wherein said torso is weighted by a rubber balloon whose neck projects through a slit in the casing whereby pressurized liquid may be fed into the balloon to inflate it, the neck thereafter being tied to confine the water within the balloon.

4. A figure as set forth in claim 1, wherein said stuffing material is cotton batting.

5. A figure as set forth in claim 1, wherein said stuffing material is of flexible, synthetic plastic foam.

6. A figure as set forth in claim 1, wherein said appendages are each formed of a fabric stocking filled with stuffing material and attached to said casing.

7. A figure as set forth in claim 1, wherein said backpack is provided with shoulder loops and a waist strap.

* * * * *